US007680427B2

(12) United States Patent
Nakazawa

(10) Patent No.: US 7,680,427 B2
(45) Date of Patent: Mar. 16, 2010

(54) IMAGE FORMING APPARATUS

(75) Inventor: Yoshio Nakazawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 299 days.

(21) Appl. No.: 11/790,161

(22) Filed: Apr. 24, 2007

(65) Prior Publication Data

US 2007/0248375 A1 Oct. 25, 2007

(30) Foreign Application Priority Data

Apr. 25, 2006 (JP) ..... 2006-120299

(51) Int. Cl.
*G03G 15/00* (2006.01)

(52) U.S. Cl. ..... 399/88; 399/285; 363/125; 363/126

(58) Field of Classification Search ..... 399/285, 399/88; 363/125, 126
See application file for complete search history.

(56) References Cited

U.S. PATENT DOCUMENTS 4,314,755 A * 2/1982 Kinashi ..... 399/44
4,791,528 A * 12/1988 Suzuki et al. ..... 361/235
4,819,145 A * 4/1989 Maeba ..... 363/63
2004/0057753 A1 * 3/2004 Choi et al. ..... 399/228
2006/0034109 A1 * 2/2006 Benabdelaziz et al. ..... 363/125

FOREIGN PATENT DOCUMENTS

JP 2000-102261 A 4/2000
JP 3264001 B2 12/2001
JP 2002-162870 A 6/2002

* cited by examiner

*Primary Examiner*—David M Gray
*Assistant Examiner*—Roy Yi
(74) *Attorney, Agent, or Firm*—Sughrue Mion, PLLC

(57) ABSTRACT

A high voltage power supply apparatus according to the present invention is a high voltage power supply apparatus that applies a bias voltage at least to a developing roller of a developing unit, the apparatus comprising: a transformer that increases an AC voltage and includes a main winding and a sub winding on the secondary side thereof; a first capacitor whose first end is connected to a common connection point between the main and sub windings; a second capacitor whose first end is connected to one end of the sub winding which is not the common connection point side; a zener diode whose both ends are connected to the second end of the first capacitor and second end of the second capacitor; and a DC voltage application section that applies a DC voltage to the zener diode, wherein a voltage generated in the second end of the first capacitor is used as a voltage to be applied to the developing roller.

11 Claims, 7 Drawing Sheets

IMAGE FORMING APPARATUS

CROSS-REFERENCE TO RELATED APPLICATION

This application is based upon and claims the benefit of priority from prior Japanese Patent Application No. 2006-120299, filed Apr. 25, 2006, the entire contents including specification, drawings, abstract of which are incorporated herein by reference.

BACKGROUND OF THE INVENTION

1. Field of the Invention

The present invention relates to a developing unit that forms uniform thin film of toner on a developer carrier and supplies toner to a latent image carrier and, more particularly, to a high voltage power supply apparatus that applies a voltage to the developer carrier, latent image carrier, and a restricting blade that constitute the developing unit and an image forming apparatus that uses the high voltage power supply apparatus.

2. Description of the Related Art

It is necessary to apply an adequate bias voltage respectively to the developer carrier, latent image carrier, and restricting blade that constitute the developing unit by the high voltage power supply apparatus. For example, Japanese Patent No. 3264001 discloses a configuration in which, in a developing unit constituted by a developing roller (developer carrier), a blade (layer thickness restricting means), and a reset roller (supply means), while a voltage is applied from a blade (layer thickness restricting means) application power supply to the blade (layer thickness restricting means), toner is transferred to the developing roller by an electrostatic force of a toner supply electric field directed from the developing roller to the reset roller generated between the potential (supply means application voltage) of the reset roller which causes friction between the toner to thereby preliminary charge the toner negatively and to which a supply means application voltage, in which a DC component and AC component are superimposed, is applied by a supply means application DC power supply and a supply means application AC power supply and potential (developing bias voltage) of the developing roller applied by a developer carrier application power supply.

SUMMARY OF THE INVENTION

A high voltage power supply apparatus for an image forming apparatus that the present inventor studied will be described. FIG. 9 is a cross-sectional view showing the main part of an image forming apparatus. In FIG. 9, in a developing unit that develops an electrostatic latent image formed on a photoconductor 107 serving as an image carrier, a developing roller 102 serving as a developer carrier is provided at the opening portion of a housing 101 that faces the photoconductor 107 and a supply roller 103 which is rotated in the same direction (directions of arrows in FIG. 9 shown with respect to rollers 102 and 103) as the developing roller 102 at the contacting portion (nip portion) with the developing roller 102 is provided in the housing. In this configuration, toner 104 contained in the housing 104 is supplied to the surface of the developing roller 102 by the supply roller 103. A gap is formed between the photoconductor 107 and developing roller 102 and, when development is performed, the toner moves in the gap to be adhered onto the photoconductor 107 to thereby develop a latent image. A seal member 105 and a restricting blade 106 are provided on the upper and lower sides of the developing roller 102. When the toner is supplied to the nip portion between the supply roller 103 and developing roller 102 by the rotation of the supply roller 103, the toner is fed in a state of being pressed between the both rollers while being friction-charged. At the same time, the restricting blade 6 restricts the toner thickness and friction-charges the toner. The toner is then fed from the developing roller 102 to its opposing portion on the photoconductor 107 to thereby performing an AC jumping development.

Next, a high voltage power supply apparatus that supplies a bias voltage to the image forming apparatus having the above configuration will be described. FIG. 10 is a view showing a circuit configuration of a high voltage power supply apparatus for the image forming apparatus, and FIG. 11 is a view showing waveforms of voltages to be applied to the developing roller, supply roller, and restricting blade by the high voltage power supply apparatus. In FIG. 10, the primary side of a transformer T is excited by an AC power supply that generates a rectangular waveform at a several kHz to thereby generate a voltage of about 1200 to 1500 V (peak to peak) on the secondary side of transformer T. Further, a DC voltage is superimposed on the generated voltage to form a potential difference by a zener diode ZD between Ta and Tb, thereby obtaining a voltage waveform as shown in FIG. 11. In FIG. 11, the vertical axis denotes voltage and horizontal axis denotes time. Further, in FIG. 11, a dotted line denotes a voltage waveform applied to the developing roller 102, and a solid line denotes a voltage waveform applied to the supply roller 103 and restricting blade 106. The terminal Ta is connected to the developing roller 102, and terminal Tb is connected to the supply roller 103 and restricting blade 106, and the terminals Ta and Tb receive bias voltages, respectively.

A metal roller made of iron or aluminum is used as the developing roller 102. This developing roller 102 can be used without causing a particular problem in normal use. However, in the case where the developing roller 102 is used at high altitudes, the air becomes thin to thereby lower the discharge limit, causing a discharge between the photoconductor 107 and developing roller 102. Because of this problem, it has been necessary to use, as a bias voltage to be applied to the developing roller 102, one that exhibits a low margin of error from a specified voltage. That is, it has required that the amplitude accuracy of the voltage waveform of the rectangular waveform indicated by Vp-p of FIG. 11 be increased especially. However, in the circuit configuration as shown in FIG. 10, a bias voltage applied to the developing roller varies depending on the individual difference of the zener diode ZD. In order to control the variation, the zener diode ZD has needed to be replaced by another one. In particular, when a circuit for supplying a high voltage bias to a color image forming apparatus is designed based on the circuit configuration shown in FIG. 10, this problem becomes obvious.

To solve the above problem, according to a first aspect of the present invention, there is provided a high voltage power supply apparatus that applies a bias voltage at least to a developing roller of a developing unit, comprising: a transformer that increases an AC voltage and includes a main winding and a sub winding on the secondary side thereof; a first capacitor whose first end is connected to a common connection point between the main and sub windings; a second capacitor whose first end is connected to one end of the sub winding which is not the common connection point side; a zener diode whose both ends are connected to the second end of the first capacitor and second end of the second capacitor; and a DC voltage application section that applies a DC voltage to the zener diode, wherein a voltage generated in the second end of the first capacitor is used as a voltage to be applied to the developing roller.

Further, according to a second aspect of the present invention, there is provided a high voltage power supply apparatus that applies a bias voltage at least to a developing roller of a developing unit, comprising: a transformer which increases an AC voltage and includes a main winding and a sub winding on the secondary side thereof; a first resistor whose first end is connected to a common connection point between the main and sub windings; a second resistor whose first end is connected to one end of the sub winding which is not the common connection point side; a first capacitor whose first end is connected to the second end of the first resistor; a second capacitor whose first end is connected to the second end of the second resistor; a zener diode whose both ends are connected to the second end of the first capacitor and second end of the second capacitor; and a DC voltage application section that applies a DC voltage to the zener diode, wherein a voltage generated in the second end of the first capacitor is used as a voltage to be applied to the developing roller.

Further, according to a third aspect of the present invention, there is provided a high voltage power supply apparatus that applies a bias voltage at least to a developing roller of a developing unit, comprising: a transformer that increases an AC voltage and includes a main winding and a sub winding on the secondary side thereof; a first capacitor whose first end is connected to a common connection point between the main and sub windings; a second capacitor whose first end is connected to one end of the sub winding which is not the common connection point side; a high voltage diode whose both ends are connected to the second end of the first capacitor and second end of the second capacitor; and a DC voltage application section that applies a DC voltage to the high voltage diode, wherein a voltage generated in the second end of the first capacitor is used as a voltage to be applied to the developing roller.

Further, according to a fourth aspect of the present invention, there is provided a high voltage power supply apparatus that applies a bias voltage at least to a developing roller of a developing unit, comprising: a transformer that increases an AC voltage and includes a main winding and a sub winding on the secondary side thereof; a first capacitor whose first end is connected to a common connection point between the main and sub windings; a second capacitor whose first end is connected to one end of the sub winding which is not the common connection point side; first and second zener diodes whose anodes are connected in series; and a DC voltage application section that applies a DC voltage to the first zener diode, wherein the second end of the first capacitor is connected to the cathode of the first zener diode, the second end of the second capacitor is connected to the cathode of the second zener diode, and a voltage generated in the second end of the first capacitor is used as a voltage to be applied to the developing roller.

Further, according to a fifth aspect of the present invention, there is provided a high voltage power supply apparatus that applies a bias voltage at least to a developing roller of a developing unit, comprising: a transformer that increases an AC voltage and includes a main winding and a sub winding on the secondary side thereof; a first resistor whose first end is connected to a common connection point between the main and sub windings; a second resistor whose first end is connected to one end of the sub winding which is not the common connection point side; a first capacitor whose first end is connected to the second end of the first resistor; a second capacitor whose first end is connected to the second end of the second resistor; first and second zener diodes whose anodes are connected in series; and a DC voltage application section that applies a DC voltage to the first zener diode, wherein the second end of the first capacitor is connected to the cathode of the first zener diode, the second end of the second capacitor is connected to the cathode of the second zener diode, and a voltage generated in the second end of the first capacitor is used as a voltage to be applied to the developing roller.

Further, according to a sixth aspect of the present invention, there is provided a high voltage power supply apparatus that applies a bias voltage at least to a developing roller of a developing unit, comprising: a transformer that increases an AC voltage and includes a main winding and a sub winding on the secondary side thereof; a first capacitor whose first end is connected to a common connection point between the main and sub windings; a second capacitor whose first end is connected to one end of the sub winding which is not the common connection point side; first and second zener diodes connected in series in a forward direction; and a DC voltage application section that applies a DC voltage to the first zener diode, wherein the second end of the first capacitor is connected to the cathode of the first zener diode, the second end of the second capacitor is connected to the anode of the second zener diode, and a voltage generated in the second end of the first capacitor is used as a voltage to be applied to the developing roller.

Further, according to a seventh aspect of the present invention, there is provided a high voltage power supply apparatus that applies a bias voltage at least to developing rollers of a plurality of developing units, comprising: a transformer that increases an AC voltage and includes a main winding and a sub winding on the secondary side thereof; a plurality of first capacitors the first end of each of which is connected to a common connection point between the main and sub windings; a plurality of second capacitors the first end of each of which is connected to one end of the sub winding which is not the common connection point side; a plurality of zener diodes both ends of each of which are connected to the second end of the first capacitor and second end of the second capacitor; and a plurality of DC voltage application sections that apply DC voltages to the plurality of zener diodes, wherein voltages generated in the second ends of the plurality of first capacitors are used as voltages to be applied to the developing rollers.

Further, according to an eighth aspect of the present invention, there is provided an image forming apparatus comprising the high voltage power supply apparatus according to any of the above aspects.

In the image forming apparatus, the developing roller is made of metal.

According to the present invention, it is possible to provide a high voltage power supply apparatus capable of supplying a bias voltage having a voltage waveform with a high amplitude accuracy to a developing roller without depending on the individual difference of electric components such as a zener diode and an image forming apparatus using the high voltage power supply apparatus.

DETAILED DESCRIPTION OF THE PREFERRED EMBODIMENTS

Figure 1:
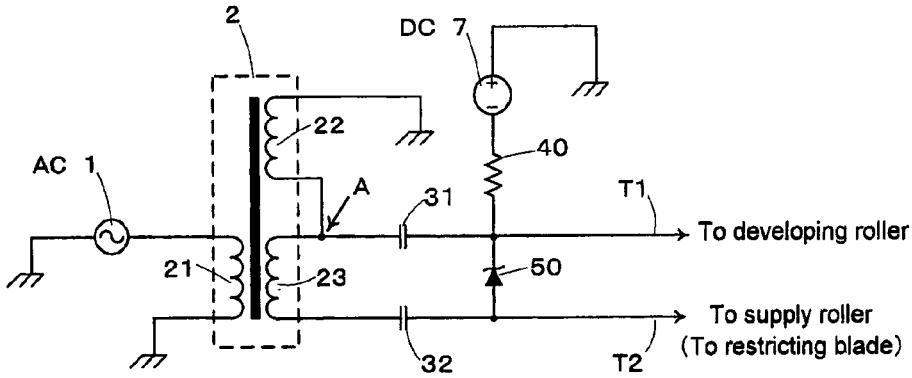
FIG. 1 is a view showing a circuit configuration of a high voltage power supply apparatus according to a first embodiment of the present invention.

Embodiments of the present invention will be described below with reference to the accompanying drawings. FIG. 1 is a view showing a circuit configuration of a high voltage power supply apparatus according to a first embodiment of the present invention. Since the configuration of the image forming apparatus to which a bias voltage is applied by this high voltage power supply apparatus is the same as that shown in FIG. 9 and waveforms of bias voltages applied to respective components are the same as those shown in FIG. 11, they will be described with reference to FIGS. 9 and 11.

In FIG. 1, 1 is an AC power supply section, 2 is a transformer, 31 and 32 are capacitors, 40 is a resistor, 50 is a zener diode, and 7 is a DC power supply section. The transformer 2 is constituted by a primary winding 21 and secondary windings including a main winding 22 and a sub winding 23. A terminal T1 is connected to the developing roller 102, and terminal T2 is connected to the supply roller 103 and restricting blade 106, and the terminals T1 and T2 receive bias voltages, respectively.

One end of the main winding 22 of the transformer 2 is grounded and the other end thereof is connected to the sub winding 23, and this connection point is drawn as a tap A from the transformer 2. The tap A is connected to the cathode of the zener diode 50 through the capacitor 31, and the other side of the sub winding 23 (not the tap A side) is connected to the anode of the zener diode 50 through the capacitor 32. To the cathode of the zener diode 50, as shown in FIG. 1, the DC power supply section 7 having one terminal grounded is connected through the resistor 40. The bias voltage to be applied to the developing roller 102 is taken from the cathode of the zener diode 50 as the terminal T1, and the bias voltage to be applied to the supply roller 103 and restricting blade 106 is taken from the anode of the zener diode 50 as the terminal T2.

Next, operation of the circuit configuration described above will be described. The AC power supply section 1 applies a waveform (sine wave, rectangular wave, or the like) of a given shape corresponding to a duty and frequency desired to be generated to the primary winding 21 of the transformer 2 for high voltage generation to excite the winding 21. Although the AC power supply section 1 provides a voltage of 24 V for driving mechanical components by switching at a frequency of 2 to 4 kHz in a typical image forming apparatus, the configuration of the AC power supply section 1 is not limited to this. Further, although a rectangular wave is typically used as a bias voltage applied to the developing unit constituted by the developing roller 102 and supply roller 103, the bias voltage applied to the developing unit is not limited to this. The secondary main winding 22 which generates a voltage amplitude to be supplied to the developing roller 102 and secondary sub winding 23 for biasing the zener diode 50 are connected to each other as the secondary winding, and the potential difference between the terminal T1 and T2 is maintained by the zener diode 50.

In the present embodiment, the negative polarity of the bias voltage is defined by the zener voltage of the zener diode 50, and positive polarity of the bias voltage is defined by forward voltage drop (about 0.6 V, in the case of silicon) of the zener diode 50. Further, a direct voltage of the DC power supply section is connected to the cathode of the zener diode 50 through the resistor 40. A voltage of a range between about −100 V and 400 V is used as the direct voltage of the DC power supply section.

As described above, the tap A is connected to the cathode of the zener diode 50 by the capacitor 31, and the other side of the sub winding 23 (not the tap A side) is connected to the anode of the zener diode 50 by the capacitor 32. These capacitors transfer an AC component but block a DC component.

Figure 11:
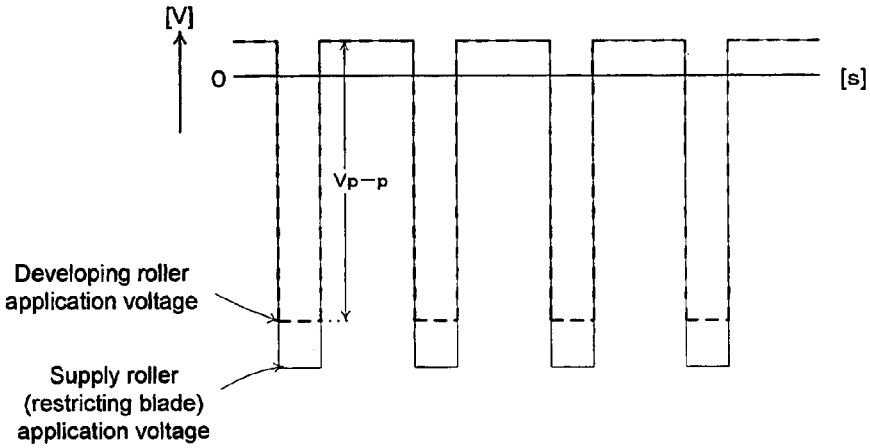
FIG. 11 is a view showing waveforms of voltages to be applied to the developing roller, supply roller, and restricting blade by the high voltage power supply apparatus.

With the above operation, as shown in FIG. 11, an AC voltage on which a DC voltage has been superimposed is applied to the developing roller 102, supply roller 103, and restricting blade 106, respectively, as a bias voltage. Further, a line from the terminal T1 is connected to the developing roller 102, and a line from the terminal T2 is connected to the supply roller 103 and restricting blade 106 for application of a bias voltage. The present embodiment adopts a circuit system in which a potential difference is generated between the bias voltage applied to the developing roller 102 and that applied to the supply roller 103 and restricting blade 106 at the negative peak time.

In the present embodiment, a bias voltage is connected from a line from the tap A of the transformer 2 to the terminal T1 to the developing roller 102. This line is less subject to the influence of the zener diode 50 and, therefore, a bias voltage with a high amplitude accuracy can be supplied from the line. Further, in the case where a multiple stage of taps are provided, it is possible to further increase accuracy by selecting an optimum tap from these taps.

According to the need to an electrophotographic system, an optimum circuit system can be selected with respect to electric polarity (zener diode, DC power supply section), connection order (connection configuration between developing roller, supply roller, restricting blade, and high voltage power supply), AC power supply section (waveform shape such as sine wave or rectangular wave, duty, frequency).

Figure 2:
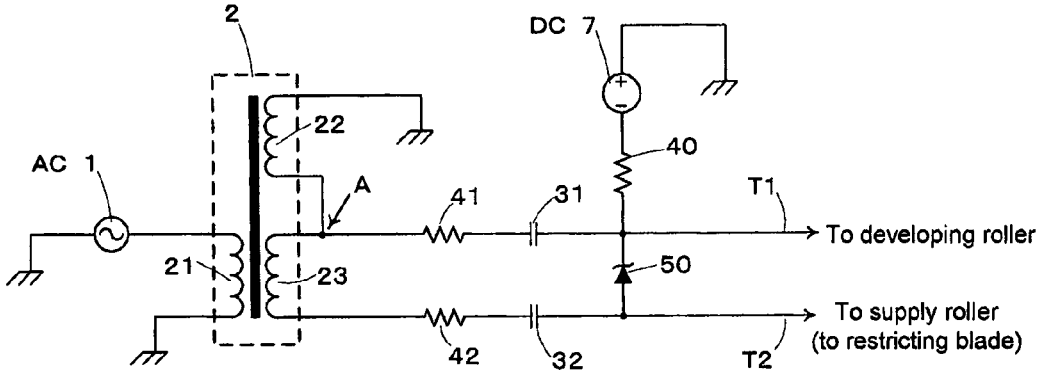
FIG. 2 is a view showing a circuit configuration of a high voltage power supply apparatus according to a second embodiment of the present invention.

Next, a high voltage power supply apparatus according to another embodiment will be described. FIG. 2 is a view showing a circuit configuration of a high voltage power supply apparatus according to a second embodiment of the present invention. The present embodiment differs from the first embodiment in that resistors 41 and 42 are provided respectively between the tap A and capacitor 31 and between the other side of the sub winding 23 (not the tap A side) and capacitor 32. An overshoot may occur in the transformer 2 for a high voltage generation due to its frequency characteristics in some cases. The resistor 41 serves as a damping resistor for suppressing occurrence of the overshoot between the transformer 2 and capacitances. Further, the resistor 42 is a resistor for absorbing the voltage difference between the zener voltage of the zener diode 50 and AC voltage generated by the secondary winding 23 for biasing the zener diode 50. Also in the present embodiment, the same effect as in the first embodiment can be obtained.

Figure 3:
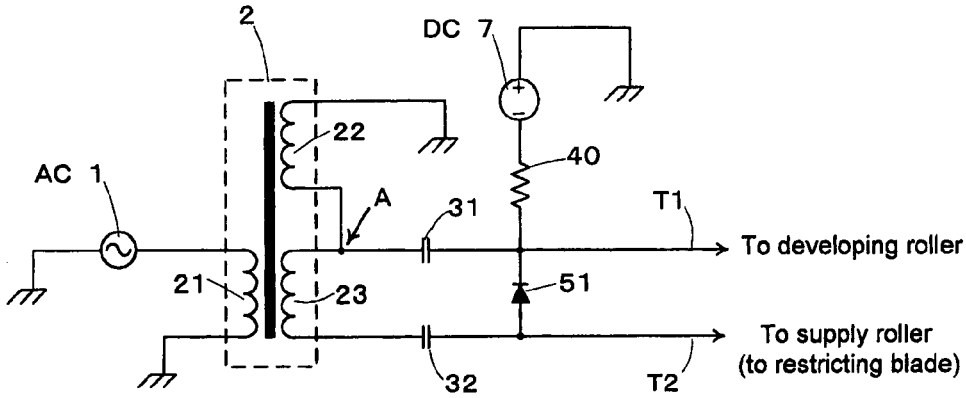
FIG. 3 is a view showing a circuit configuration of a high voltage power supply apparatus according to a third embodiment of the present invention.

Next, a high voltage power supply apparatus according to another embodiment will be described. FIG. 3 is a view showing a circuit configuration of a high voltage power supply apparatus according to a third embodiment of the present invention. The present embodiment differs from the first embodiment in that a high voltage diode 51 is used in place of the zener diode 50. In the present embodiment, the potential difference between the terminals T1 and T2 is maintained constant by the high voltage diode 51. Further, in the present embodiment, the negative polarity of the bias voltage is defined by a voltage generated by the secondary winding of the transformer 2 for AC voltage generation, and positive polarity of the bias voltage is defined by forward voltage drop (about 0.6 V, in the case of silicon) of the diode. Also in the present embodiment, the same effect as in the first embodiment can be obtained.

Figure 4:
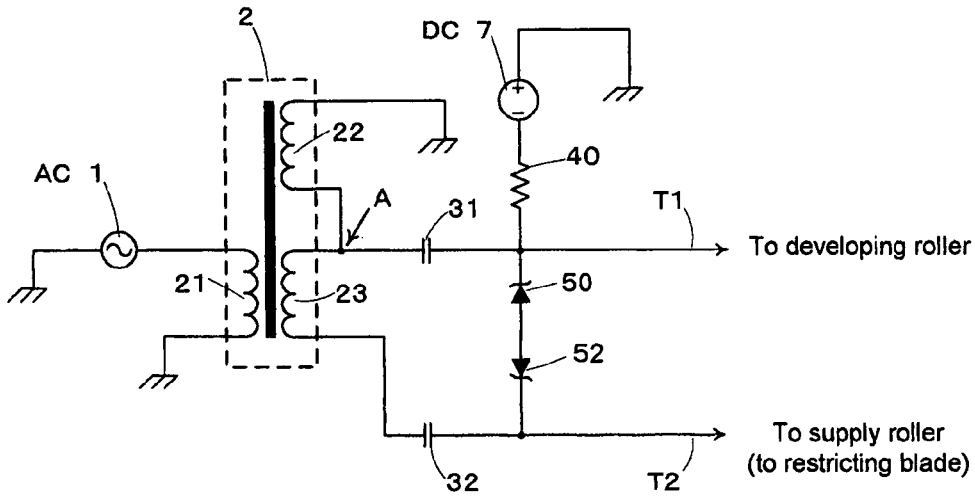
FIG. 4 is a view showing a circuit configuration of a high voltage power supply apparatus according to a fourth embodiment of the present invention.

Next, a high voltage power supply apparatus according to another embodiment will be described. FIG. 4 is a view showing a circuit configuration of a high voltage power supply apparatus according to a fourth embodiment of the present invention. The present embodiment differs from the first embodiment in that a zener diode 52 is connected in series to the zener diode 50 in a reversed polarity. In the present embodiment, the potential difference between the terminals T1 and T2 is maintained constant by the two zener diodes 50 and 52. Further, in the present embodiment, the negative polarity of the bias voltage is defined by a zener voltage of the upper side zener diode 50, and positive polarity of the bias voltage is defined by a zener voltage of the lower side zener diode 52. Also in the present embodiment, the same effect as in the first embodiment can be obtained.

Figure 5:
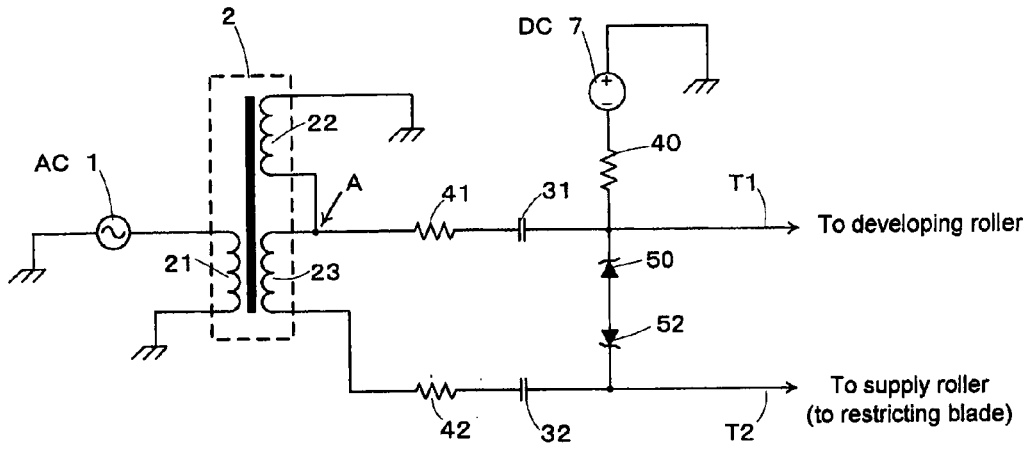
FIG. 5 is a view showing a circuit configuration of a high voltage power supply apparatus according to a fifth embodiment of the present invention.

Next, a high voltage power supply apparatus according to another embodiment will be described. FIG. 5 is a view showing a circuit configuration of a high voltage power supply apparatus according to a fifth embodiment of the present invention. The present embodiment differs from the fourth embodiment in that resistors 41 and 42 are provided respectively between the tap A and capacitor 31 and between the other side of the sub winding 23 (not the tap A side) and capacitor 32. An overshoot may occur in the transformer 2 for a high voltage generation due to its frequency characteristics in some cases. The resistor 41 serves as a damping resistor for suppressing occurrence of the overshoot between the transformer 2 and capacitances. Further, the resistor 42 is a resistor for absorbing the voltage difference between the zener voltage of the zener diode 50 and AC voltage generated by the secondary winding 23 for biasing the zener diode 50. In the present embodiment, the potential difference between the terminals T1 and T2 is maintained constant by the two zener diodes 50 and 52. Further, in the present embodiment, the negative polarity of the bias voltage is defined by a zener voltage of the upper side zener diode 50, and positive polarity of the bias voltage is defined by a zener voltage of the lower side zener diode 52. Also in the present embodiment, the same effect as in the first embodiment can be obtained.

Figure 6:
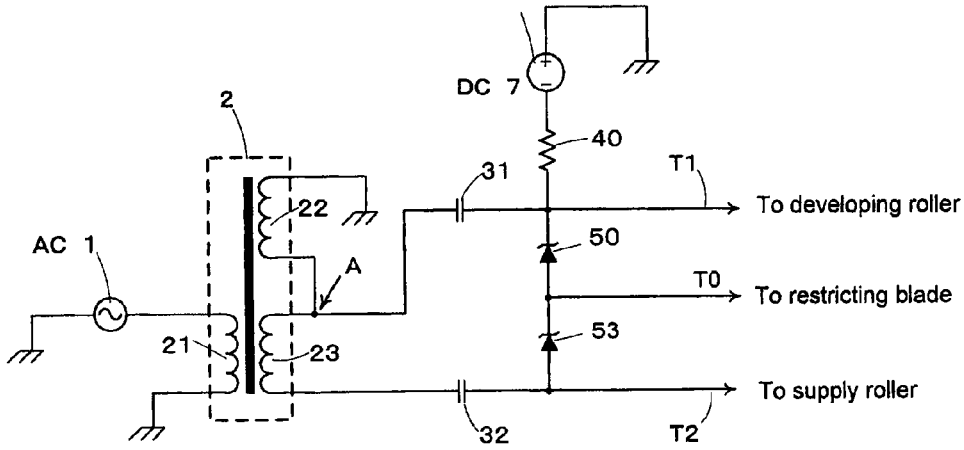
FIG. 6 is a view showing a circuit configuration of a high voltage power supply apparatus according to a sixth embodiment of the present invention.
Figure 7:
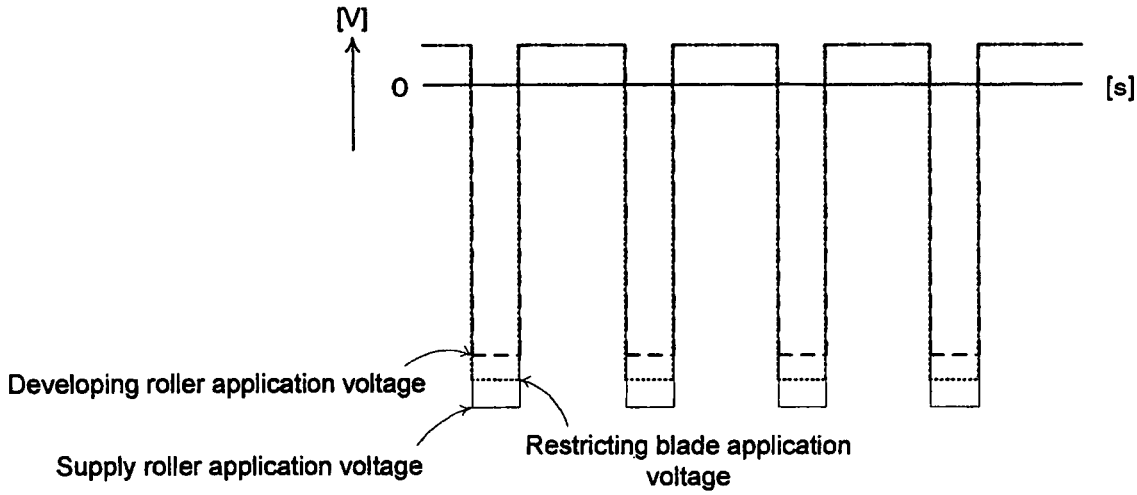
FIG. 7 is a view showing waveforms of voltages to be applied to a developing roller, supply roller, and restricting blade by the high voltage power supply apparatus according to the sixth embodiment.

Next, a high voltage power supply apparatus according to another embodiment will be described. FIG. 6 is a view showing a circuit configuration of a high voltage power supply apparatus according to a sixth embodiment of the present invention, and FIG. 7 is a view showing waveforms of voltages to be applied to a developing roller, supply roller, and restricting blade by the high voltage power supply apparatus according to the sixth embodiment. The present embodiment differs from the first embodiment in that bias voltages having potential differences are applied to the developing roller 102, restricting blade 106 and supply roller 103. The waveform of the applied bias voltage is shown in FIG. 7. In FIG. 7, the vertical axis denotes voltage and horizontal axis denotes time. Further, in FIG. 7, a rough dotted line denotes a voltage waveform applied to the developing roller 102, a fine doted line denotes a voltage waveform applied to the restricting blade 106, and a solid line denotes a voltage waveform applied to the supply roller 103.

In a concrete configuration, the present embodiment differs from the first embodiment in that a zener diode 53 is connected in series to the zener diode 50 on the anode side thereof in the same polarity and that a terminal T0 is taken from the anode of the zener diode 50 (i.e., from the cathode of the zener diode 53). The terminal T1 is connected to the developing roller 102, terminal T0 is connected to the restricting blade 106, and terminal T2 is connected to the supply roller 103, and the terminals T1, T0, and T2 receive bias voltages as shown in FIG. 7, respectively. Also in the present embodiment, the same effect as in the first embodiment can be obtained.

Figure 8:
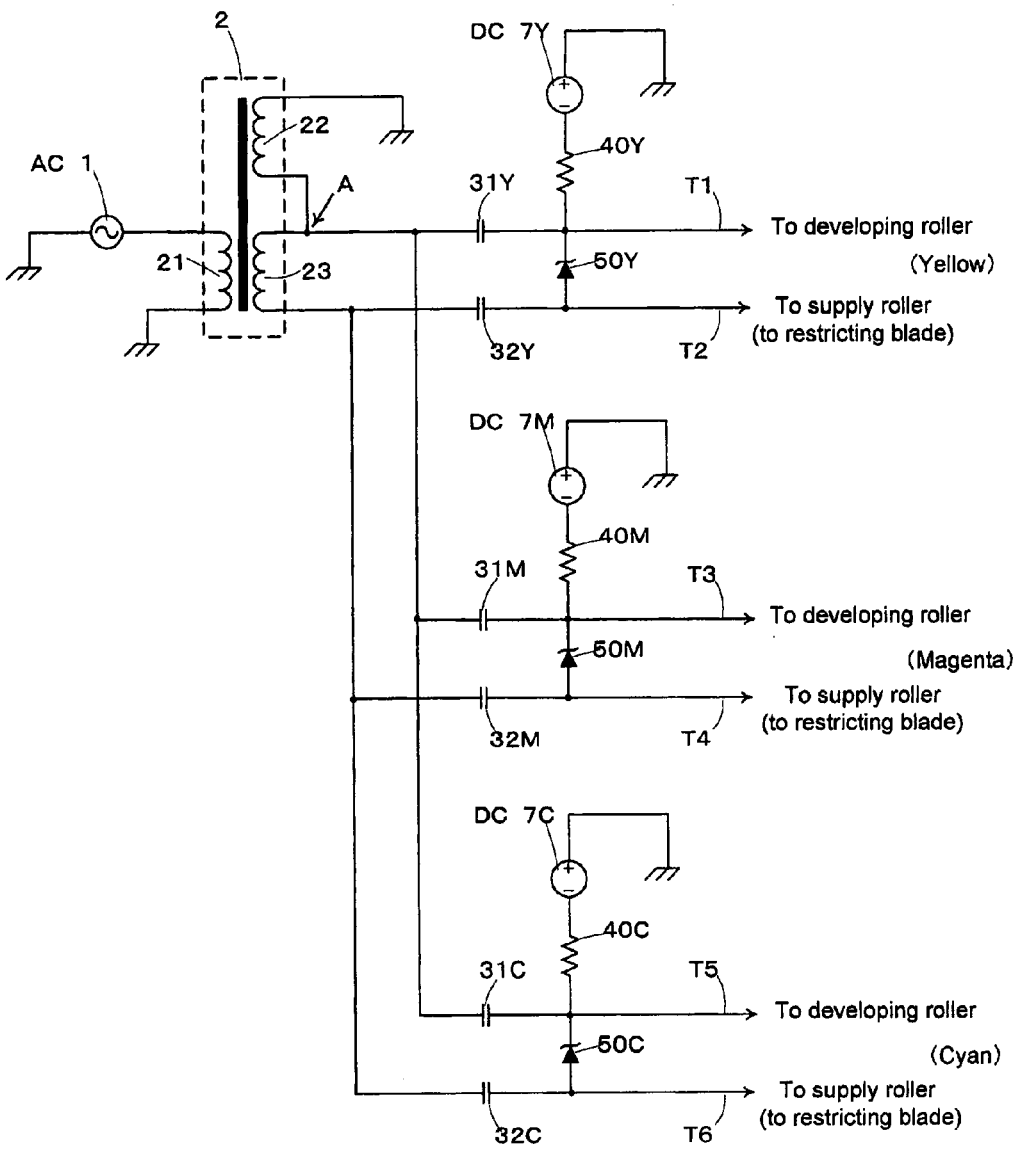
FIG. 8 is a view showing a circuit configuration of a high voltage power supply apparatus according to a seventh embodiment of the present invention.
Figure 9:
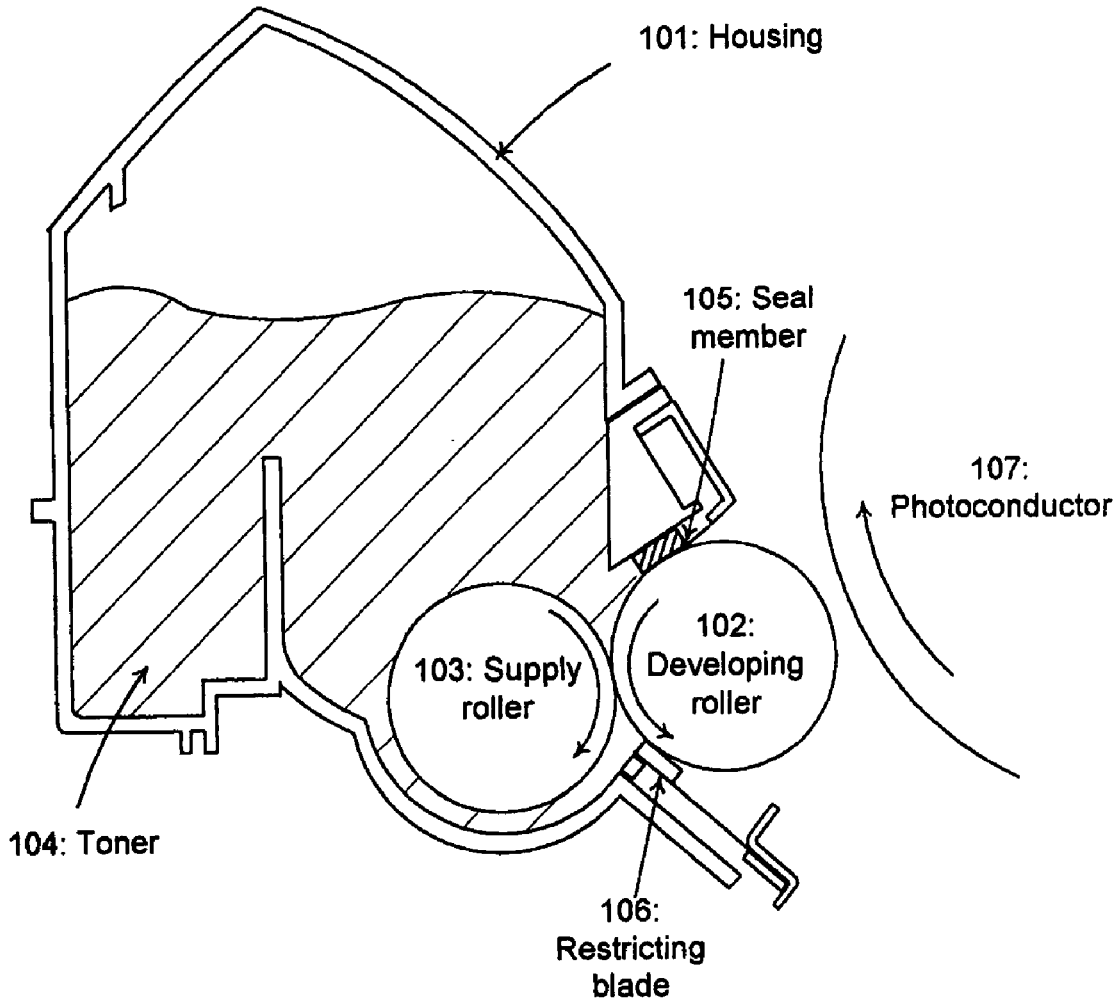
FIG. 9 is a cross-sectional view showing the main part of an image forming apparatus.

Next, a high voltage power supply apparatus according to another embodiment will be described. FIG. 8 is a view showing a circuit configuration of a high voltage power supply apparatus according to a seventh embodiment of the present invention. The present embodiment is a circuit configuration of a high voltage power supply apparatus for supplying a high voltage bias to so-called a tandem-type color image forming apparatus, in particular. The tandem-type color image forming apparatus includes photoconductors using toners in respective colors (cyan, magenta, yellow, and black) and developing units for developing the respective photoconductors arranged in a line. That is, the tandem-type color image forming apparatus has four image forming units one of which is shown in FIG. 9. Therefore, this color image forming apparatus requires a circuit configuration for applying a high bias voltage to the developing rollers 102, supply rollers 103, and restricting blade 106 of the four developing units. In such a color image forming apparatus, printing in black and white is more frequently used than color printing, so that only black toner is often operated independently of the other color toners and, correspondingly, a high voltage power supply apparatus for applying a bias voltage to the developing units is separated into two sets, one for black toner and the other for other color toners in some cases. In view of such a case, the present embodiment intends to achieve a circuit configuration for applying a bias voltage to the developing units of cyan, magenta, and yellow which becomes required when color printing is performed.

In FIG. 8, the different point from the first embodiment is that a voltage raised by the transformer 2 is supplied from the tap A and the other side of the sub winding 23 (not the tap A side) to three circuits for respective colors. Note that Y, M, and C are added to the ends of the respective reference numbers of the circuits for yellow, magenta, and cyan.

Figure 10:
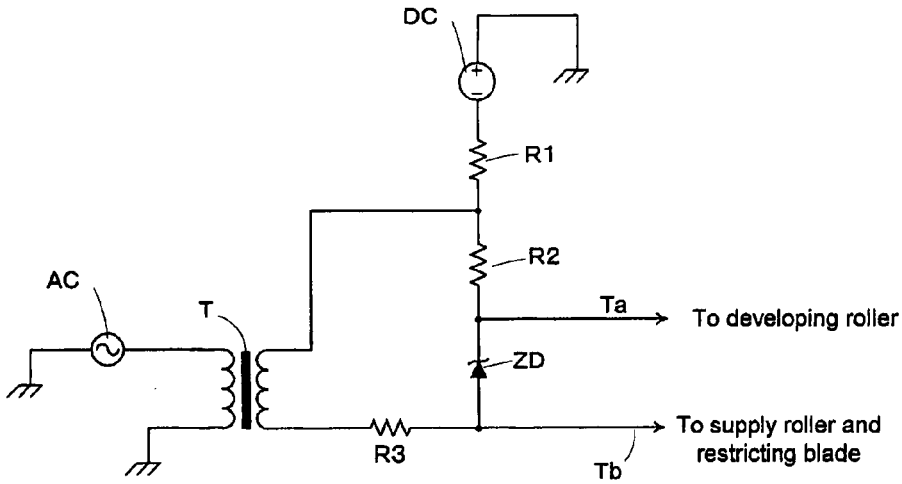
FIG. 10 is a view showing a circuit configuration of a high voltage power supply apparatus for an image forming apparatus.

In the present embodiment, although a bias voltage is connected to the developing rollers 102 of the respective colors from a line extending between the tap A of the transformer 2 and terminal 1, the respective lines toward the developing rollers 102 of the respective colors are less subject to the influence of the zener diodes 50Y, 50M and 50C provided in the circuits for respective colors and, therefore, a bias voltage with a high amplitude accuracy can be supplied from these lines to the respective developing rollers. In particular, in the case where the high voltage power supply apparatus for applying a bias voltage to a tandem-type color image forming apparatus is constituted based on the conventional circuit shown in FIG. 10, when the transformer 2 is shared between the circuits for respective colors, it is necessary to perform control for the circuits for yellow, magenta, and cyan while replacing the zener diodes of the respective circuits in order to apply a bias voltage to the developing rollers with high accuracy. On the other hand, according to the present embodiment, a bias voltage with a high amplitude accuracy can be supplied to the respective developing rollers as described above, without such a control operation. Further, for example, in the case where a multiple stage of taps are provided in the transformer 2, it is possible to further increase accuracy by selecting an optimum tap from these taps.

Although the present invention has been described with reference to the various embodiments, it is possible to provide a further preferred embodiment by combining the second embodiment that uses a damping resistor and the like and third embodiment using a high voltage diode, or it is possible to apply this newly achieved embodiment to a high voltage power supply apparatus for applying a bias voltage to the above tandem-type color image forming apparatus. The applications achieved by such a combination are all included in the scope of the present invention.

What is claimed is:

1. An image forming apparatus comprising:

a high voltage power supply apparatus that applies a bias voltage at least to a developing roller of a developing unit, the high voltage power supply apparatus comprising:

a transformer that increases an AC voltage and includes a main winding and a sub winding on the secondary side thereof;

a first capacitor whose first end is connected to a common connection point between the main and sub windings;

a second capacitor whose first end is connected to one end of the sub winding which is not the common connection point side;

a zener diode having a first end connected to the second end of the first capacitor and a second end connected to the second end of the second capacitor; and a DC voltage application section that applies a DC voltage to the zener diode, wherein a voltage generated in the second end of the first capacitor is used as a voltage to be applied to the developing roller, and the developing roller is made of metal.

2. An image forming apparatus comprising:

a high voltage power supply apparatus that applies a bias voltage at least to a developing roller of a developing unit, the high voltage power supply apparatus comprising:

a transformer that increases an AC voltage and includes a main winding and a sub winding on the secondary side thereof;

a first resistor whose first end is connected to a common connection point between the main and sub windings;

a second resistor whose first end is connected to one end of the sub winding which is not the common connection point side;

a first capacitor whose first end is connected to the second end of the first resistor;

a second capacitor whose first end is connected to the second end of the second resistor;

a zener diode having a first end connected to the second end of the first capacitor and a second end connected to the second end of the second capacitor; and a DC voltage application section that applies a DC voltage to the zener diode, wherein a voltage generated in the second end of the first capacitor is used as a voltage to be applied to the developing roller, and the developing roller is made of metal.

3. An image forming apparatus comprising:

a high voltage power supply apparatus that applies a bias voltage at least to a developing roller of a developing unit, the high voltage power supply apparatus comprising:

a transformer that increases an AC voltage and includes a main winding and a sub winding on the secondary side thereof;

a first capacitor whose first end is connected to a common connection point between the main and sub windings;

a second capacitor whose first end is connected to one end of the sub winding which is not the common connection point side;

a high voltage diode whose both ends are connected to the second end of the first capacitor and second end of the second capacitor; and a DC voltage application section that applies a DC voltage to the high voltage diode, wherein a voltage generated in the second end of the first capacitor is used as a voltage to be applied to the developing roller, and the developing roller is made of metal.

4. An image forming apparatus comprising:

a high voltage power supply apparatus that applies a bias voltage at least to a developing roller of a developing unit, the high voltage power supply apparatus comprising:

a transformer that increases an AC voltage and includes a main winding and a sub winding on the secondary side thereof;

a first capacitor whose first end is connected to a common connection point between the main and sub windings;

a second capacitor whose first end is connected to one end of the sub winding which is not the common connection point side;

first and second zener diodes whose anodes are connected in series; and a DC voltage application section that applies a DC voltage to the first zener diode, wherein the second end of the first capacitor is connected to the cathode of the first zener diode, the second end of the second capacitor is connected to the cathode of the second zener diode, a voltage generated in the second end of the first capacitor is used as a voltage to be applied to the developing roller, and the developing roller is made of metal.

5. An image forming apparatus comprising:

a high voltage power supply apparatus that applies a bias voltage at least to a developing roller of a developing unit, the high voltage power supply apparatus comprising:

a transformer that increases an AC voltage and includes a main winding and a sub winding on the secondary side thereof;

a first resistor whose first end is connected to a common connection point between the main and sub windings;

a second resistor whose first end is connected to one end of the sub winding which is not the common connection point side;

a first capacitor whose first end is connected to the second end of the first resistor;

a second capacitor whose first end is connected to the second end of the second resistor;

first and second zener diodes whose anodes are connected in series; and a DC voltage application section that applies a DC voltage to the first zener diode, wherein the second end of the first capacitor is connected to the cathode of the first zener diode, the second end of the second capacitor is connected to the cathode of the second zener diode, a voltage generated in the second end of the first capacitor is used as a voltage to be applied to the developing roller, and the developing roller is made of metal.

6. An image forming apparatus comprising:

a high voltage power supply apparatus that applies a bias voltage at least to a developing roller of a developing unit, the high voltage power supply apparatus comprising:

a transformer that increases an AC voltage and includes a main winding and a sub winding on the secondary side thereof;

a first capacitor whose first end is connected to a common connection point between the main and sub windings;

a second capacitor whose first end is connected to one end of the sub winding which is not the common connection point side;

first and second zener diodes connected in series in a forward direction; and a DC voltage application section that applies a DC voltage to the first zener diode, wherein the second end of the first capacitor is connected to the cathode of the first zener diode, the second end of the second capacitor is connected to the anode of the second zener diode, a voltage generated in the second end of the first capacitor is used as a voltage to be applied to the developing roller, and the developing roller is made of metal.

7. An image forming apparatus comprising:

a high voltage power supply apparatus that applies a bias voltage at least to developing rollers of a plurality of developing units, the high voltage power supply apparatus comprising:

a transformer that increases an AC voltage and includes a main winding and a sub winding on the secondary side thereof;

a plurality of first capacitors the first end of each of which is connected to a common connection point between the main and sub windings;

a plurality of second capacitors the first end of each of which is connected to one end of the sub winding which is not the common connection point side;

a plurality of zener diodes, wherein a first end of each of the zener diodes is connected to the second end of the first capacitor and a second end of each of the zener diodes is connected to the second end of the second capacitor; and a plurality of DC voltage application sections that apply DC voltages to the plurality of zener diodes, wherein voltages generated in the second ends of the plurality of first capacitors are used as voltages to be applied to the developing rollers, and the developing roller is made of metal.

8. The image forming apparatus according to claim 1, wherein the first end of the zener diode is only connected to one of the second end of the first capacitor and the second end of the second capacitor and the second end of the zener diode is only connected to the remaining one of the second end of the first capacitor and the second end of the second capacitor.

9. The image forming apparatus according to claim 1, wherein the first end of the zener diode is directly connected to the second end of the first capacitor and the second end of the zener diode is directly connected to the second end of the second capacitor.

10. The image forming apparatus according to claim 2, wherein the first end of the zener diode is only connected to one of the second end of the first capacitor and the second end of the second capacitor and the second end of the zener diode is only connected to the remaining one of the second end of the first capacitor and the second end of the second capacitor.

11. The image forming apparatus according to claim 2, wherein the first end of the zener diode is directly connected to the second end of the first capacitor and the second end of the zener diode is directly connected to the second end of the second capacitor.

* * * * *